US006952847B1

(12) United States Patent
Cleary

(10) Patent No.: US 6,952,847 B1
(45) Date of Patent: Oct. 11, 2005

(54) ADJUSTABLE BED RAILS INCLUDING AN ATTACHABLE HEADBOARD

(76) Inventor: Dianne L. Cleary, 34 Stratton Road, Swindon, Wilts (GB) SN1 2PR ( * ) Notice: Subject to any disclaimer, the term of this patent is extended or adjusted under 35 U.S.C. 154(b) by 0 days.

(21) Appl. No.: 10/801,027

(22) Filed: Mar. 15, 2004

(51) Int. Cl.[7] ..... A47C 21/08
(52) U.S. Cl. ..... 5/430; 5/426
(58) Field of Search ..... 5/430, 5.31, 425–428, 5/905, 663, 505.1

(56) References Cited

U.S. PATENT DOCUMENTS

| | | | | |
|---|---|---|---|---|
| 1,991,111 | A * | 2/1935 | Murrell | 362/130 |
| 2,649,594 | A * | 8/1953 | Herz et al. | 5/425 |
| 2,722,693 | A * | 11/1955 | Wolf | 5/426 |
| 2,854,677 | A * | 10/1958 | Baker et al. | 5/430 |
| 2,991,487 | A | 7/1961 | Beckwell | |
| 3,402,409 | A | 9/1968 | Kain | |
| 4,833,743 | A | 5/1989 | Howell et al. | |
| 5,519,905 | A | 5/1996 | Bernstein et al. | |
| D391,792 | S | 3/1998 | Sherer et al. | |
| 5,761,756 | A * | 6/1998 | Nowak et al. | 5/426 |
| 6,148,459 | A * | 11/2000 | Verhulst | 5/503.1 |
| 6,233,765 | B1 * | 5/2001 | Verhulst | 5/503.1 |
| 6,347,422 | B2 | 2/2002 | Heavrin | |
| 6,374,440 | B1 * | 4/2002 | Thim, Jr. | 5/633 |
| 6,401,281 | B1 | 6/2002 | Younge | |

* cited by examiner

*Primary Examiner*—Robert G. Santos

(57) ABSTRACT

A safety device for a bed includes a plurality of padded members and a plurality of support bars connectable to the plurality of padded members via a plurality of fastening members. The plurality of support bars have opposed end portions rotatably engageable with each other. Select ones of the end portions include a plurality of notches spaced thereabout and are positionable below a mattress to thereby prevent the plurality of padded members from moving beyond a fixed position. The apparatus further includes a mechanism including a plurality of spring members for selectively locking the plurality of support bars at predetermined positions. The locking mechanism further includes a plurality of guide members secured to the plurality of support bars and a plurality of elongated locking bars removably positionable through the plurality of guide members respectively.

9 Claims, 4 Drawing Sheets

ADJUSTABLE BED RAILS INCLUDING AN ATTACHABLE HEADBOARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to bed rails and, more particularly, to adjustable bed rails that prevent a child from falling out of a bed, yet allow easy access to a child when desired.

2. Prior Art

Foldable or collapsible bed rails are used on adult sized beds to prevent young children from falling out of the bed and are normally purchased to avoid the expensive practice of purchasing so called "youth beds" that are used only temporarily because they are longer and wider than cribs but lower and smaller than adult beds. It is also advantageous to use collapsible bed rails for small children when traveling or staying overnight at a dwelling provided with only adult beds.

Safety side rails for beds or the like are well-known in the art. A known safety side rail apparatus includes a pair of spaced-apart foot members adapted to be placed under a side edge of a mattress, and a side panel secured to the foot member for preventing a child from falling off the mattress. When the safety side rail is no longer needed, the foot members are withdrawn from the mattress and pivoted inwardly into substantial alignment with the side panel for storage. A disadvantage of this known type of safety side rail is that it is difficult for an adult to reach over the safety side rail when it is mounted on the bed to lift the baby out of the bed to or change the baby's diaper. A need exists for a safety side rail having a panel which can be readily moved from a safe-closed position for blocking or preventing a child from falling off a bed, and an open position allowing ready access to the child, even though the safety side rail is still mounted on the bed.

Accordingly, a need remains for bed rails that are easily adjustable for accessing a sleeping child.

BRIEF SUMMARY OF THE INVENTION

In view of the foregoing background, it is therefore an object of the present invention to provide an apparatus that prevents a child from falling out of a bed and allows easy access to the child. These and other objects, features, and advantages of the invention are provided by a portable apparatus engageable with a bed for assisting to maintain a person thereon. The apparatus includes a plurality of padded members having a plurality of centrally disposed longitudinal axes respectively.

The plurality of padded members include top and bottom edge portions substantially equally spaced from their corresponding axis and extend substantially parallel thereto respectively. The plurality of padded members further include front and rear end portions integral with the top and bottom edge portions. Each padded member may include a plurality of fastening members formed from Velcro, for example.

The apparatus further includes a plurality of support bars connectable to the plurality of padded members via the plurality of fastening members respectively and for maintaining same at a substantially secure position. The plurality of support bars have opposed end portions rotatably engageable with each other, respectively, and adjacent the front and rear end portions respectively. Select ones of the end portions include a plurality of notches spaced thereabout and are positionable below a mattress to thereby prevent the plurality of padded members from moving beyond a fixed position.

The apparatus further includes a mechanism for selectively locking the plurality of support bars at predetermined positions so that the plurality of padded members can be selectively maintained thereagainst. The locking mechanism includes a plurality of guide members secured to the plurality of support bars and a plurality of elongated locking bars removably positionable through the plurality of guide members respectively. The plurality of locking bars extend between the top edge and the bottom edge respectively and include bottom end portions selectively positionable within the plurality of notches as the plurality of support bars are pivoted in an arcuate path.

The locking mechanism further includes a plurality of spring members positioned between the plurality of end portions and select ones of the plurality of guide members. When the plurality of locking bars are lifted outwardly from the plurality of notches, the plurality of spring members are compressed, creating a resistive force until the plurality of locking bars are returned to an original position wherein the plurality of spring members become uncompressed.

The apparatus further includes a headboard and a nightlight removably engageable with same. The headboard includes a plurality of fastening members for removably attaching same to the plurality of padded members. One of the plurality of fastening members may extend along a length of the headboard. The plurality of padded members may also include a storage member and a cup holder connected thereto.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
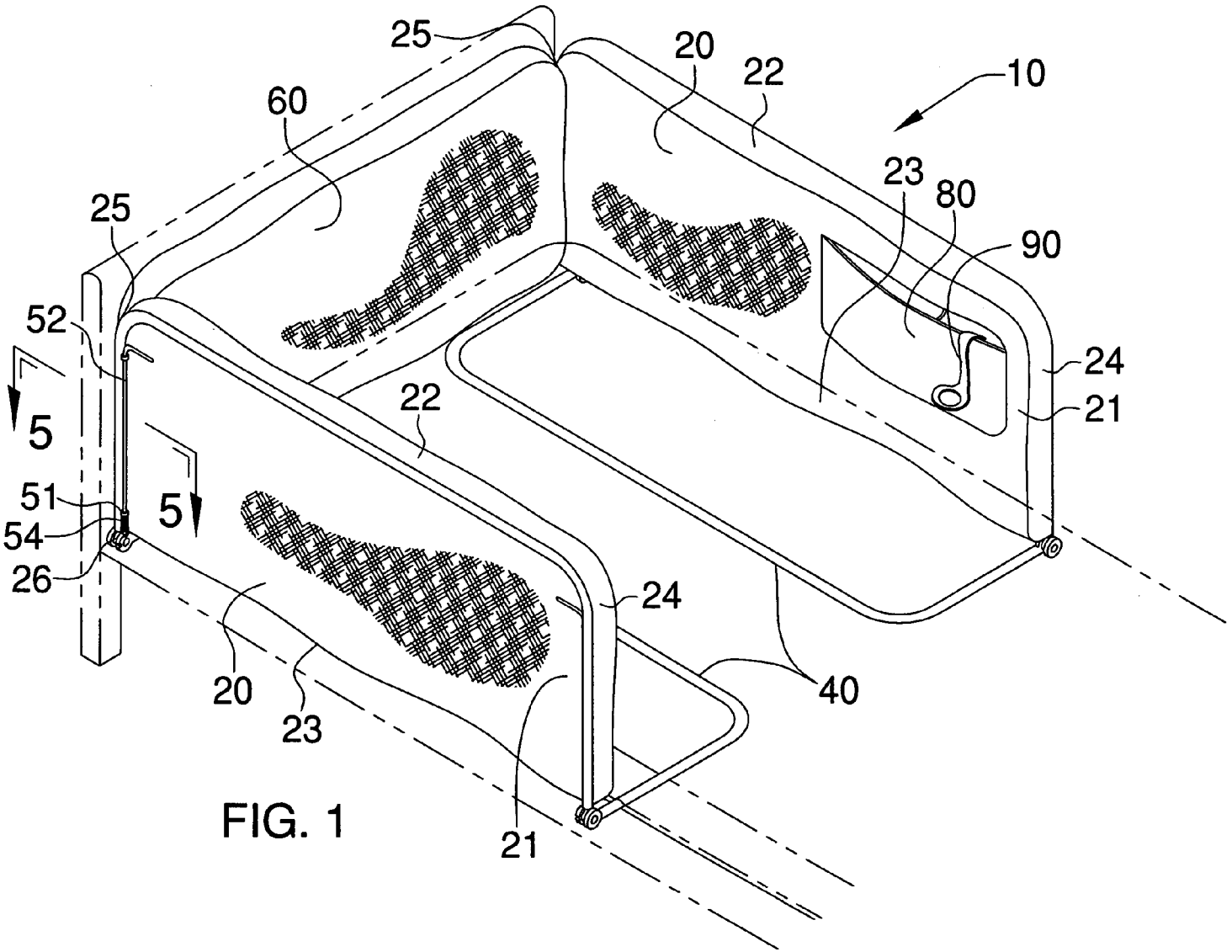
FIG. 1 is a perspective view showing adjustable bed rails including an attachable headboard, in accordance with the present invention.
Figure 2:
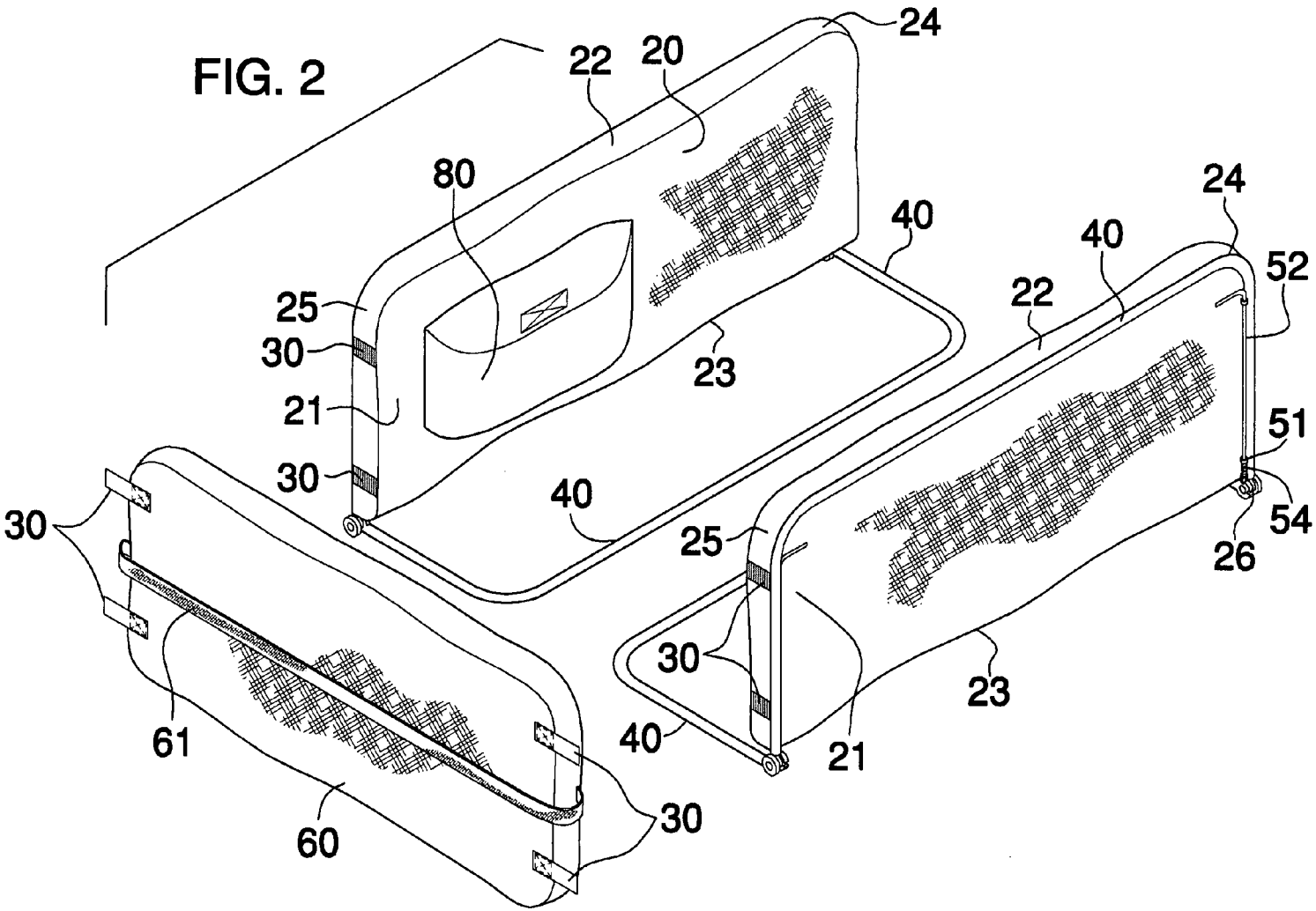
FIG. 2 is a perspective view of FIG. 1 showing the headboard detached from the bed rails.
Figure 3:
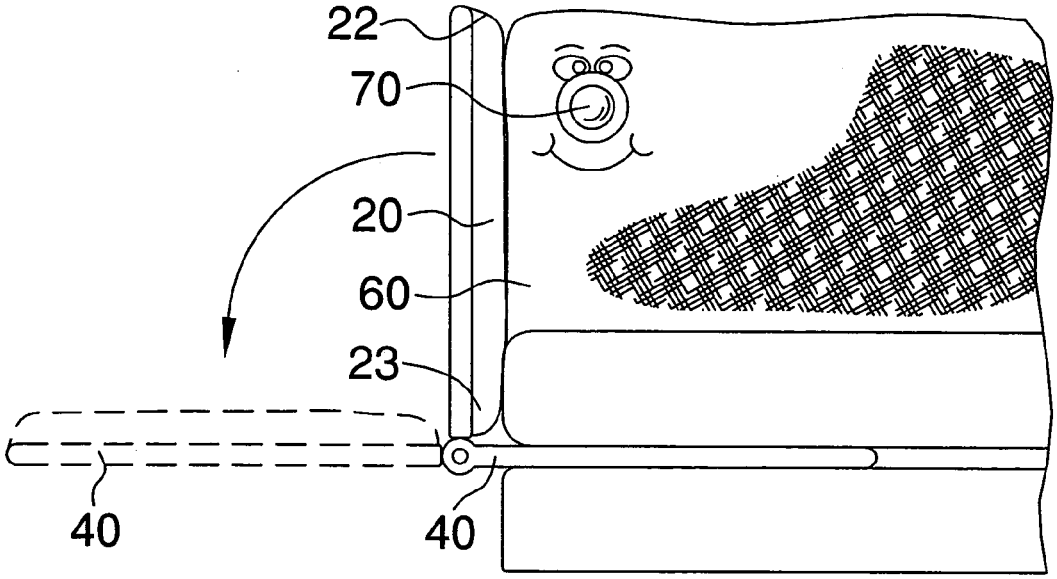
FIG. 3 is a partial rear elevational view of FIG. 1.
Figure 4:
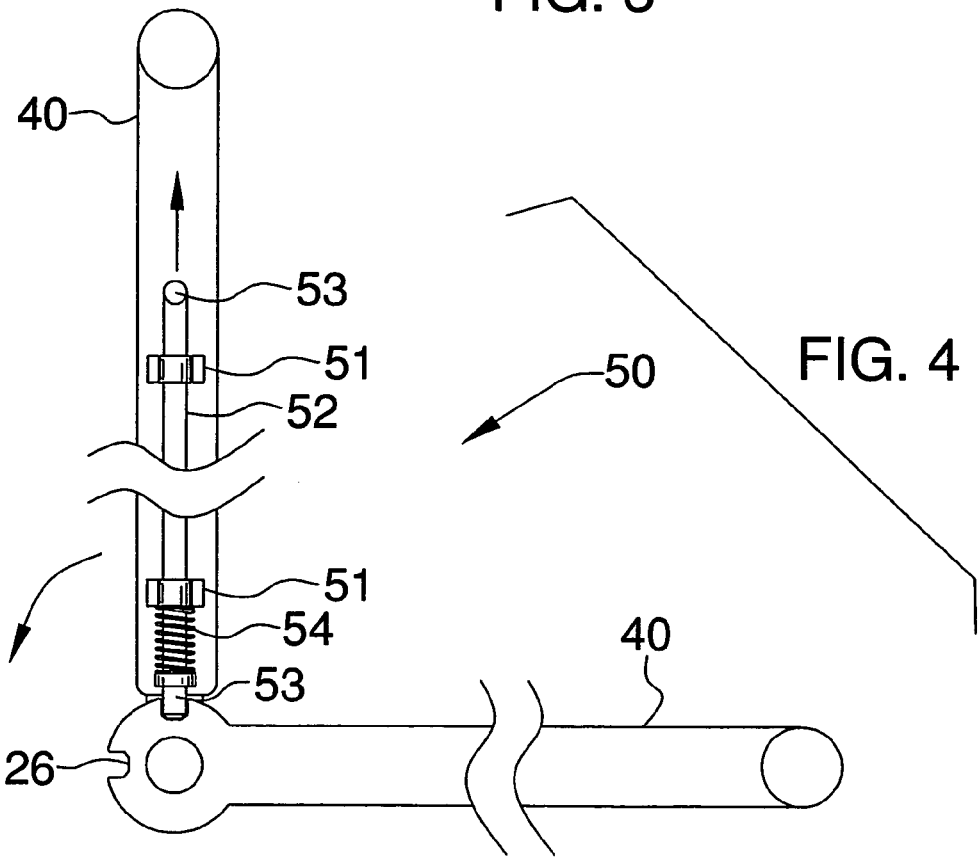
FIG. 4 is a side elevational view of the locking mechanism, in accordance with the present invention.
Figure 5:
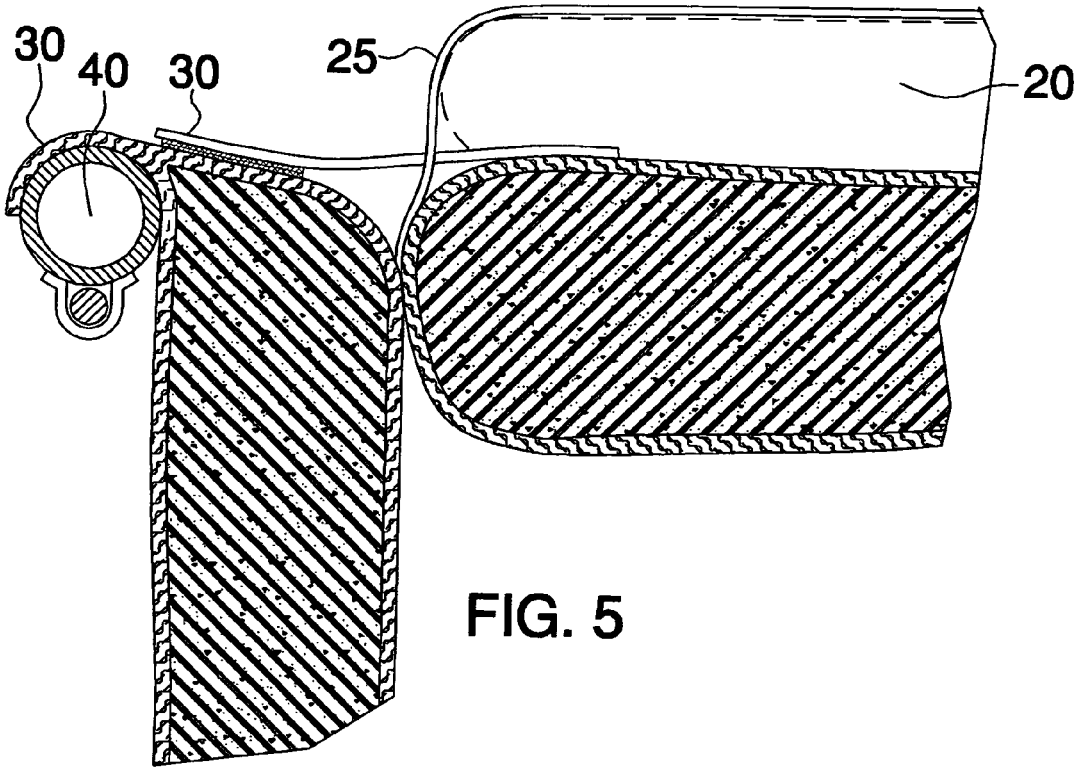
FIG. 5 is an enlarged cross-sectional view taken along line 5—5.
Figure 6:
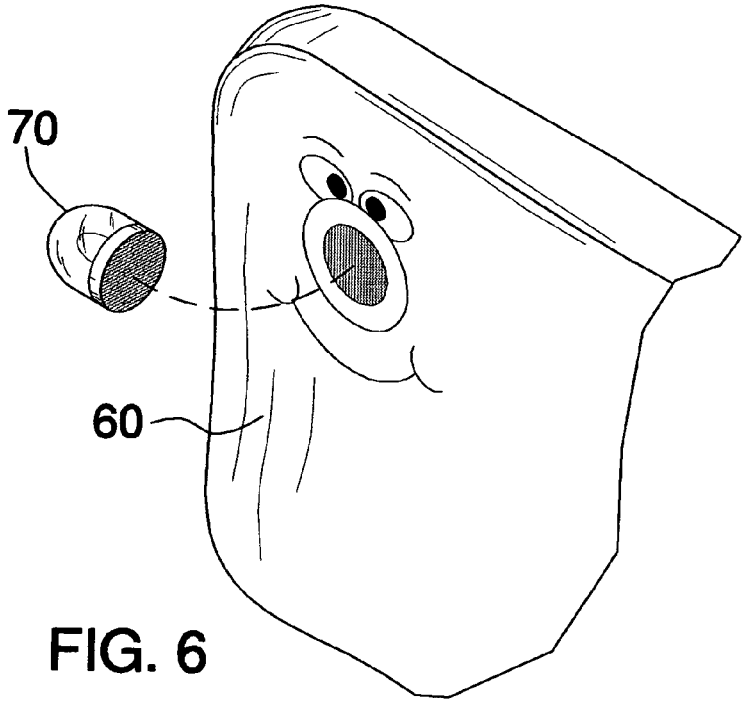
FIG. 6 is a perspective view showing a nightlight removably attachable to the headboard.

The apparatus of this invention is referred to generally in FIGS. 1–6 by the reference numeral 10 and is intended to provide an apparatus engageable with a bed for assisting to maintain a person thereon. It should be understood that the apparatus 10 may be used to maintain persons of all ages on a bed, including the elderly, and should not be limited to only small children.

The apparatus 10 includes a plurality of padded members 20 having a plurality of centrally disposed longitudinal axes 21 respectively. The plurality of padded members 20 include top 22 and bottom 23 edge portions substantially equally spaced from the corresponding axis 21 and extending substantially parallel thereto respectively. The plurality of padded members 20 further include front 24 and rear 25 end portions integral with the top 22 and bottom 23 edge portions and a plurality of fastening members 30 formed from Velcro material, for example. Such fastening members 30 are attached to the padded members 20 and extend outwardly therefrom. Advantageously, Velcro allows a user to easily remove the padded members 20 for transporting or washing. The padded members 20 are preferably formed of polyurethane foam, as well known in the industry, to provide cushion to a child who might roll over against them.

The apparatus 10 further includes a plurality of support bars 40 connectable to the plurality of padded members 20 via the plurality of fastening members 30 respectively and for maintaining same at a substantially secure position. The plurality of support bars 40 have opposed end portions 41 rotatably engageable with each other, respectively, and adjacent the front 24 and rear 25 end portions respectively. This allows a user to fold down the support bars 40 for easy access to a child. Select ones of the end portions 25 include a plurality of notches 26 spaced thereabout and are positionable below a mattress to thereby prevent the plurality of padded members 20 from moving beyond a fixed position.

The apparatus 10 further includes a mechanism 50 or selectively locking the plurality of support bars 40 at predetermined positions so that the plurality of padded members 20 can be selectively maintained thereagainst. This enables a user to selectively adjust the amount of space available for the child on the bed and thus, accommodate the needs of growing children. The locking mechanism 50 includes a plurality of guide members 51 secured to the plurality of support bars 40, and a plurality of elongated locking bars 52 removably positionable through the plurality of guide members 51 respectively. The plurality of locking bars 52 extend between the top edge 22 and the bottom 23 edge respectively and include bottom end portions 53 selectively positionable within the plurality of notches 26 as the plurality of support bars 40 are pivoted in an arcuate path.

The locking mechanism 50 further includes a plurality of spring members 54 positioned between the plurality of end portions 53 and select ones of the plurality of guide members 51. When the plurality of locking bars 52 are lifted outwardly from the plurality of notches 26, the plurality of spring members 54 are compressed, creating a resistive force until the plurality of locking bars 52 are returned to an original position wherein the plurality of spring members 54 become uncompressed.

The apparatus 10 further includes a headboard 60 and a nightlight 70 removably engageable with same. The headboard 60 includes a plurality of fastening members 61 for removably attaching same to the plurality of padded members 20. One of the plurality of fastening members 61 extends along a length of the headboard 60. The plurality of padded members 20 also include a storage member 80 and a cup holder 90 connected thereto. Advantageously, the storage member 80 and cup holder 90 are conveniently located for parents' use while attending a child. In addition, the storage of toys in a convenient place makes the bed a fun and inviting place for children and may help ease the transition from a crib to a child's bed.

The apparatus 10 provides increased safety and comfort to children making the transition from a crib to a child's bed and would be a valuable accessory for parents of young children. The apparatus 10 further provides a safe sleeping environment for a child and prevents a child from rolling off a bed and sustaining injuries. There are no hard surfaces for a child to bump his/her head on while sleeping or playing on the bed. Because cushioned side rails are provided for both sides of a bed, parents would no longer have to place one side of the bed against a wall to prevent a child from falling off the bed.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable apparatus engageable with a bed and for assisting to maintain a person thereon, said apparatus comprising:

a plurality of padded members having a plurality of centrally disposed longitudinal axes respectively, said plurality of padded members including top and bottom edge portions substantially equally spaced from the corresponding axis and extending substantially parallel thereto respectively, said plurality of padded members including front and rear end portions integral with said top and bottom edge portions, said plurality of padded members further including a plurality of fastening members attached thereto;

a plurality of support bars connectable to said plurality of padded members via said plurality of fastening members respectively and for maintaining same at a substantially secure position, said plurality of support bars having opposed end portions rotatably engageable with each other respectively adjacent said front and rear end portions respectively, select ones of said end portions including a plurality of notches spaced thereabout and being positionable below a mattress to thereby prevent said plurality of padded members from moving beyond a fixed position; and means for selectively locking said plurality of support bars at predetermined positions so that said plurality of padded members can be selectively maintained thereagainst and at predetermined positions, said locking means comprising a plurality of guide members secured to said plurality of support bars;

a plurality of elongated locking bars removably positionable through said plurality of guide members respectively, said plurality of locking bars including bottom end portions selectively positionable within said plurality of notches as said plurality of support bars are pivoted in an arcuate path;

a plurality of spring members positioned between said plurality of end portions and select ones of said plurality of guide members, said plurality of spring members being compressed and creating a resistive force when said plurality of locking bars are lifted outwardly from said plurality of notches until said plurality of locking bars are returned to an original position wherein said plurality of spring members become uncompressed.

2. The apparatus of claim 1, further comprising:

a headboard including a plurality of fastening members for removably attaching same to said plurality of padded members, one said plurality of fastening members extending along a length of said headboard.

3. The apparatus of claim 1, wherein said plurality of locking bars extend between the top edge and the bottom edge respectively.

4. The apparatus of claim 1, wherein said plurality of fastening members comprise a hook and loop fastener.

5. The apparatus of claim 2, further comprising:

a storage member and a cup holder connectable to said plurality of padded members; and a night light removably engageable with said headboard.

6. A portable apparatus engageable with a bed and for assisting to maintain a person thereon, said apparatus comprising:

a plurality of padded members having a plurality of centrally disposed longitudinal axes respectively, said plurality of padded members including top and bottom edge portions substantially equally spaced from the corresponding axis and extending substantially parallel thereto respectively, said plurality of padded members including front and rear end portions integral with said top and bottom edge portions, said plurality of padded members further including a plurality of fastening members attached thereto;

a plurality of support bars connectable to said plurality of padded members via said plurality of fastening members respectively and for maintaining same at a substantially secure position, said plurality of support bars having opposed end portions rotatably engageable with each other respectively adjacent said front and rear end portions respectively, select ones of said end portions including a plurality of notches spaced thereabout and being positionable below a mattress to thereby prevent said plurality of padded members from moving beyond a fixed position;

means for selectively locking said plurality of support bars at predetermined positions so that said plurality of padded members can be selectively maintained thereagainst and at predetermined positions, said locking means comprising a plurality of guide members secured to said plurality of support bars;

a plurality of elongated locking bars removably positionable through said plurality of guide members respectively, said plurality of locking bars including bottom end portions selectively positionable within said plurality of notches as said plurality of support bars are pivoted in an arcuate path;

a plurality of spring members positioned between said plurality of end portions and select ones of said plurality of guide members, said plurality of spring members being compressed and creating a resistive force when said plurality of locking bars are lifted outwardly from said plurality of notches until said plurality of locking bars are returned to an original position wherein said plurality of spring members become uncompressed; and a headboard including a plurality of fastening members for removably attaching same to said plurality of padded members, one said plurality of fastening members extending along a length of said headboard.

7. The apparatus of claim 6, wherein said plurality of locking bars extend between the top edge and the bottom edge respectively.

8. The apparatus of claim 6, wherein said plurality of fastening members comprise a hook and loop fastener.

9. The apparatus of claim 6, further comprising:

a storage member and a cup holder connectable to said plurality of padded members; and a night light removably engageable with said headboard.

* * * * *